US006190147B1

(12) United States Patent
Kimbara et al.

(10) Patent No.: US 6,190,147 B1
(45) Date of Patent: Feb. 20, 2001

(54) ROTATION BALANCING MECHANISM FOR ORBITING SCROLLS OF SCROLL-TYPE COMPRESSORS

(75) Inventors: Masahiko Kimbara; Takashi Ban, both of Kariya (JP)

(73) Assignee: Kabushiki Kaisha Toyoda Jidoshokki Seisakusho, Kariya (JP)

( * ) Notice: Under 35 U.S.C. 154(b), the term of this patent shall be extended for 0 days.

(21) Appl. No.: 09/432,311

(22) Filed: Nov. 2, 1999

(30) Foreign Application Priority Data

Nov. 5, 1998 (JP) ..... 10-315070

(51) Int. Cl.[7] ..... F03C 2/00
(52) U.S. Cl. ..... 418/55.3; 418/151
(58) Field of Search ..... 418/55.3, 151

(56) References Cited

U.S. PATENT DOCUMENTS 5,033,945 * 7/1991 Kolb ..... 418/55.3
5,556,269 * 9/1996 Suzuki et al. ..... 418/55.3
5,690,480 * 11/1997 Suzuki et al. ..... 418/55.3
5,842,842 * 12/1998 Callens et al. ..... 418/55.2
5,951,271 * 9/1999 DuMoulin et al. ..... 418/55.3

FOREIGN PATENT DOCUMENTS

2025530 * 1/1980 (GB) ..... 418/55.3
61-261689 * 11/1986 (JP) ..... 418/55.3
64-063679 3/1989 (JP) .
1-061480 4/1989 (JP) .
4-308381 * 10/1992 (JP) ..... 418/55.3
10-252668 * 9/1998 (JP) ..... 418/55.3
10-299675 * 11/1998 (JP) ..... 418/55.3

* cited by examiner

*Primary Examiner*—Thomas Denion
*Assistant Examiner*—Theresa Trieu
(74) *Attorney, Agent, or Firm*—Morgan & Finnegan, L.L.P.

(57) ABSTRACT

A rotation balancing mechanism of an orbiting scroll of a scroll-type compressor that reduces the outer diameter of the compressor housing. A compression mechanism includes a fixed scroll and an orbiting scroll. The compression mechanism is coupled to a support frame at the front of a drive motor. A drive crankshaft is located between the drive shaft of the motor and a base plate of the orbiting scroll. The drive crankshaft causes the orbiting scroll to orbit. Follower crankshafts are located between the support frame and the base plate. The follower crankshafts permit the orbiting scroll to orbit and prevent the orbiting scroll from rotating about its own axis. A central balance weight is located on the drive crankshaft. The central balance weight opposes part of the centrifugal force that is applied to the drive crankshaft when the orbiting scroll orbits. Outer balance weights are attached to the follower crankshafts to oppose the remainder of the centrifugal force.

14 Claims, 9 Drawing Sheets

ROTATION BALANCING MECHANISM FOR ORBITING SCROLLS OF SCROLL-TYPE COMPRESSORS

BACKGROUND OF THE INVENTION

The present invention relates to a rotation balancing mechanism for balancing orbiting scrolls of scroll-type compressors.

FIGS. 9 and 10 show a prior art scroll-type compressor. The scroll type compressor includes a motor housing 15 for a motor 12 and a compressor housing 31 for a compression mechanism 13. A support frame 16 is attached to the front of the motor housing 15. The compressor housing 31 is fixed to the support frame 16. The motor 12 includes a drive shaft 18. The compression mechanism 13 includes a fixed scroll 32 and an orbiting scroll 33, which includes a base plate 36. A crankshaft 51 is located between the drive shaft 18 and the orbiting scroll 33 to cause the orbiting scroll 33 to orbit. Bearing sleeves 63 are formed on the support frame 16. Bearing sleeves 66 are formed on the rear and peripheral surface of the base plate 36 of the orbiting scroll 33. Follower crankshafts 61 arc located between the bearing sleeves 63 and the outer bearing sleeves 66. The follower crankshafts 61 permit orbital movement of the orbiting scroll 33 and prevent rotation about its own axis of the orbiting scroll 33.

The orbiting scroll 33 orbits with the crank shaft 51 while rotation about its own axis of the orbiting scroll 33 is prevented by the follower crankshafts 61. This movement draws refrigerant gas from a suction chamber 39, compresses the gas in a compression chamber 38, and discharges the gas to an external refrigerant circuit through a discharge port 41. The compression chamber 38 is defined by the fixed scroll 32 and the orbiting scroll 33.

The center of gravity of the orbiting scroll 33 is located at an axis O2 of an eccentric pin 53. When the orbiting scroll 33 orbits during the operation of the compressor, a centrifugal force is applied to the eccentric pin 53. The centrifugal force is based on the moment of inertia about the axis O1 of the crankshaft 51 (drive shaft 18). That is, centrifugal force FT ($WT*R1*\omega^2$) is applied to the eccentric pin 53. R1 represents the distance between the axis O1 of the drive shaft 18 and the axis O2 of the eccentric pin 53, which is the orbiting radius of the orbiting scroll 33. The mass of the orbiting scroll 33 that orbits the axis O2 is represented by WT. The orbiting speed (angular velocity) of the orbiting scroll 33 is represented by $\omega$. Therefore, a central balance weight 57, which has a mass W, is integrally attached to the crankshaft 51. The balance weight is located on the opposite side of crankshaft 51 from the eccentric pin 53 with respect to the axis O1. The central balance weight 57 achieves dynamic balancing, that is, the net centrifugal force applied to the crankshaft 51 is null.

In the prior art scroll-type compressor shown in FIGS. 9 and 10, since the central balance weight 57 is attached only to the crankshaft 51, the following problem occurs. As shown in FIG. 10, to offset the centrifugal force FT of the orbiting scroll 33 with the single central balance weight 57, the center of gravity G1 of the central balance weight 57 must be radially spaced from the axis O1 of the drive shaft 18 and the central balance weight 57 cannot be compact. Therefore, the central path C1, which is the path of the periphery of the central balance weight 57, is relatively large.

On the other hand, the peripheral surfaces of the outer bearing sleeves 66, which support the eccentric pins 65 of the follower crankshafts 61, must not interfere with the central path C1. As a result, journal shafts 62 of the follower crankshafts 61 and outer bearing sleeves 66 are obliged to be located to extend radially from peripheral rim of the base plate 36 of the orbiting scroll 33 as shown in FIG. 10. Accordingly, to avoid interference between the outer paths C2, which are the paths of the peripheral surfaces of the outer bearing sleeves 66, and the inner surface of the housing 31, projections 31*a* must be formed on the housing 31. This increases radial size of the compressor housing 31.

Japanese Unexamined Utility Model Publication No. 1-61480 shows a compressor that is similar to the compressor of FIGS. 9 and 10. As shown in FIG. 11, the follower crankshafts 61 of the compressor shown in the publication include balance weights 81, which compensate for the mass imbalance of the crankshafts 61 when orbiting. In this case, since each balance weight 81 is formed perpendicular to a corresponding eccentric pin 65, trim weights 82, which nullify the centrifugal force of the corresponding follower crankshaft 61, are attached to the follower crankshafts 61. Therefore, the journal shafts 62 are rearwardly extended by the trim weights 82.

In the above scroll-type compressor of FIG. 11, only the balance weight that is attached to the drive crankshaft opposes the centrifugal force caused by the mass of the orbiting scroll. Therefore, the follower crankshafts 61 and the outer bearing sleeves 66 extend radially outward from the base plate 36 of the orbiting scroll 33, which increases the size of the compressor housing 31. In addition, the trim weights 82 complicate the structure and increase the mass of the compressor.

SUMMARY OF THE INVENTION

A first objective of the present invention is to provide a rotation balancing mechanism of an orbiting scroll for a scroll-type compressor that reduces the size of the compressor.

A second objective of the present invention is to provide a rotation balancing mechanism for an orbiting scroll that simplifies the structure and reduces the mass.

A third objective of the present invention is to provide a rotation balancing mechanism for an orbiting scroll that that enables smooth orbital movement of the orbiting scroll with a drive crankshaft.

To achieve the above objectives, the present invention provides a scroll type compressor structured as follows. The compressor includes a housing, a fixed scroll, and an orbiting scroll. The fixed scroll is fixed to the housing. The fixed scroll has a base and a spiral portion formed on the base. The orbiting scroll has a base and a spiral portion formed on the base to engage the fixed scroll. The orbiting scroll has a center axis offset from that of the fixed scroll. A driving crankshaft is connected to the base of the orbiting scroll to produce orbital motion. Follower crankshafts are connected to the housing and the base of the orbiting scroll to follow the motion of the orbiting scroll and to prevent the orbiting scroll from rotating about its own axis. Balance weights for balancing a moment of inertia of the orbiting scroll about the driving crankshaft. The balance weights are located on at least the follower crankshafts.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A scroll-type compressor according to a first embodiment of the present invention will now be described with reference to FIGS. 1–4.

Figure 1:
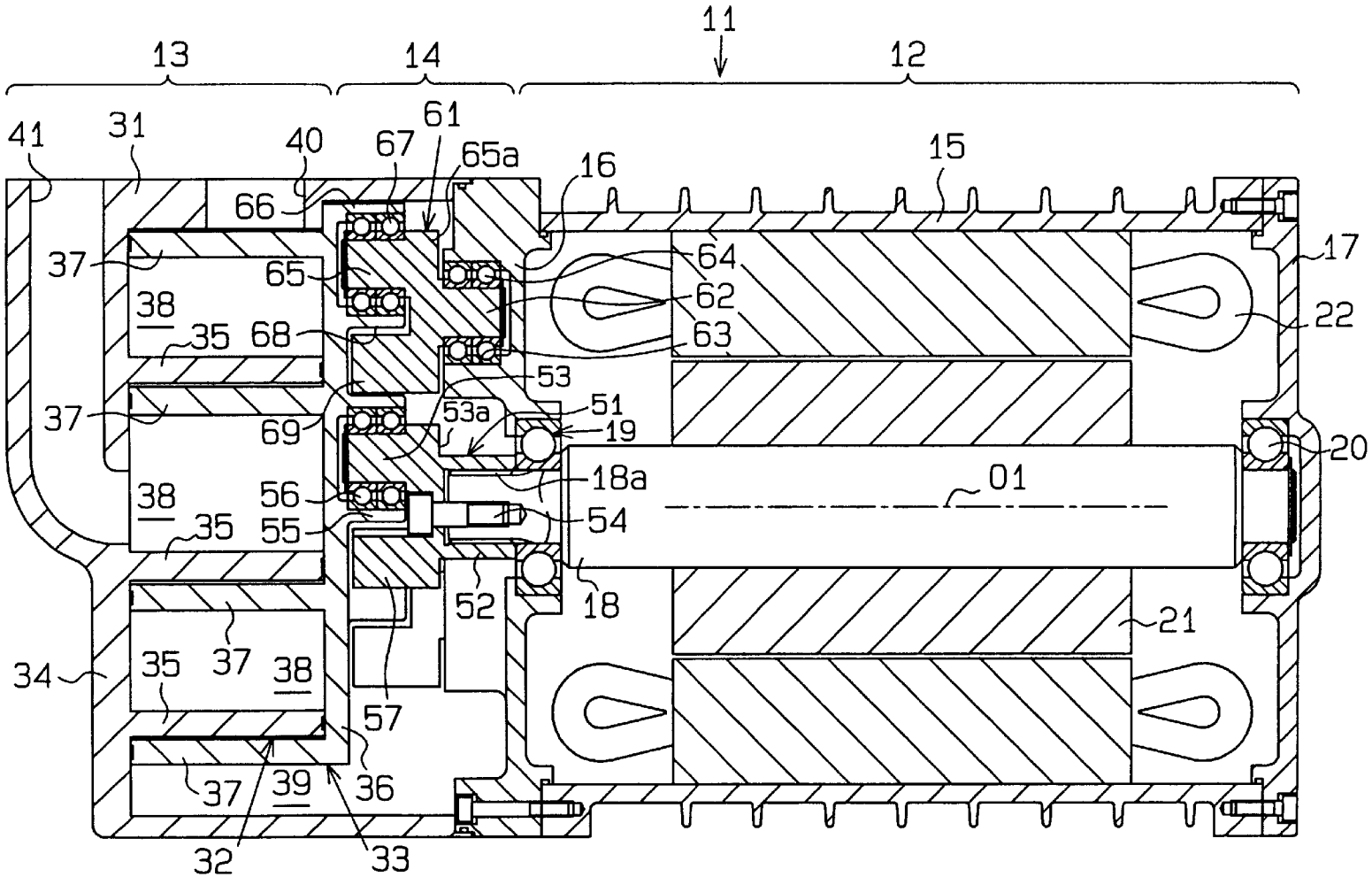
FIG. 1 is a cross-sectional view showing a scroll-type compressor according to one embodiment of the present invention.

As shown in FIG. 1, the scroll-type compressor 11 includes a drive motor 12, a compression mechanism 13, and a rotation balancing mechanism 14. The compression mechanism 13 is located frontward of the motor 12. The rotation balancing mechanism 14 is located between the motor 12 and the compression mechanism 13.

A front support frame 16 is fixed by a bolt to the front end of a cylindrical motor housing 15, which accommodates the motor 12. A rear support frame 17 is fixed by a bolt to the rear end of the motor housing 15. A drive shaft 18 is supported in the center of the front and rear support frames 16, 17 through radial ball bearings 19, 20. A rotor 21 is fitted on the drive shaft 18. Coiled wires 22 are fixed on the inner surface of the motor housing 15. When the coiled wires 22 are excited, the rotor 21 rotates with the drive shaft 18, which operates the compressor 11.

The compression mechanism 13 will now be described. A compressor housing 31 is fixed by a bolt to the front surface of the support frame 16. The support frame 16 forms part of the compressor housing 31. A fixed scroll 32 is integrally formed in the compressor housing 31. The fixed scroll 32 is engaged with an orbiting scroll 33. That is, a fixed spiral portion 35 is integrally formed on a base plate 34 of the fixed scroll 32 and an orbiting spiral portion 37 is integrally formed on a base plate 36 of the orbiting scroll 33. The spiral portions 35, 37 engage one another and contact one another at plural points. Due to the orbital motion of the orbiting scroll 33, the spiral portions 35, 37 shift with a predetermined angular displacement with respect to one another. A plurality of compression chambers 38 are formed between the fixed and orbiting spiral portions 35, 37. The compression chambers 38 shift spirally from the outer region toward the center of the engaged spiral portions 35, 37 while their volumes are reduced in response to the movement of the orbiting scroll 33.

A suction chamber 39 is formed between the peripheral surface of the orbiting scroll 33 and the inner surface of the compressor housing 31. Refrigerant gas is drawn to the suction chamber 39 from an external refrigerant circuit through an inlet 40, which is formed in the housing 31. When the orbiting scroll 33 is rotated by a rotation balancing mechanism 14, refrigerant gas in the suction chamber 39 is drawn to the compression chambers, which are formed between the fixed scroll 32 and the orbiting scroll 33. Since the radially inner compression chambers 38 have smaller volumes than the radially outer compression chambers 38, refrigerant gas is compressed as it moves from the periphery to the center and is discharged to the external refrigerant circuit through the outlet 41, which is formed in the housing 31.

The rotation balancing mechanism 14 will now be described.

Figure 4:
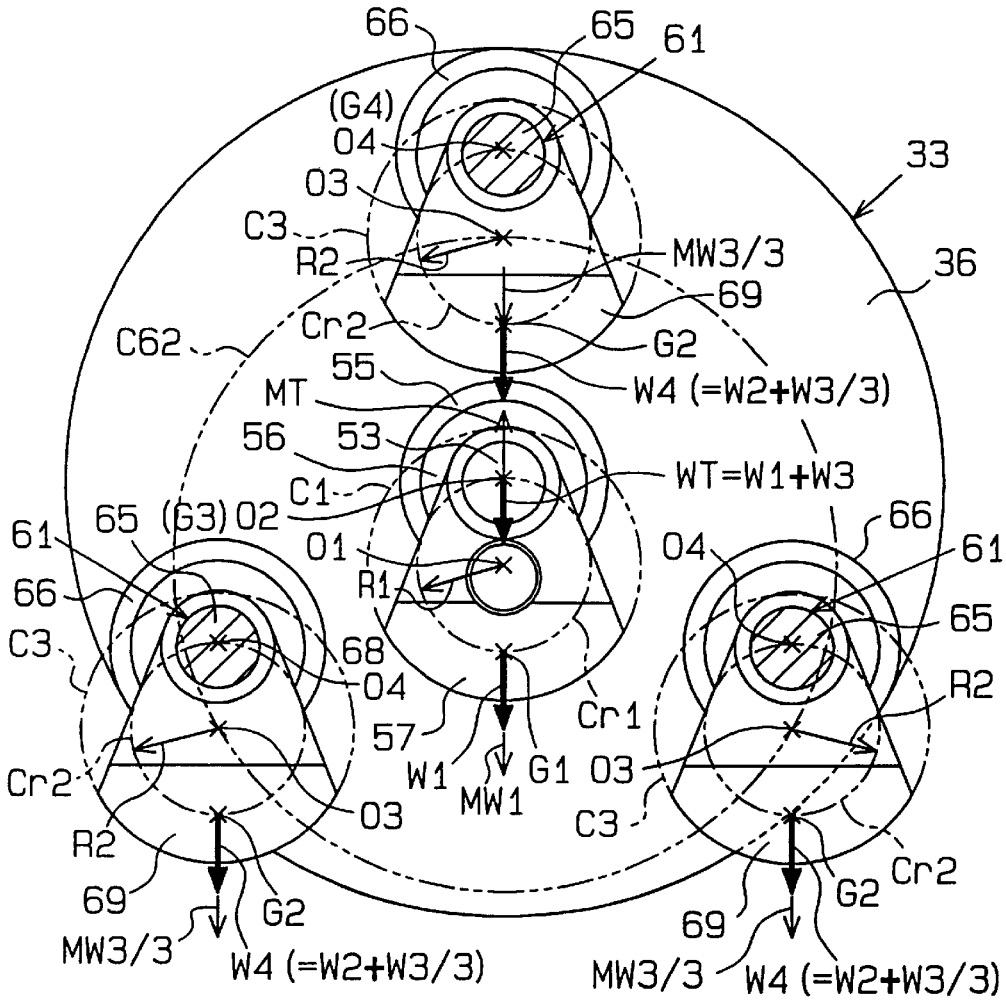
FIG. 4 is an enlarged cross-sectional view of the rotation balancing mechanism.

A drive crankshaft 51 is located between the drive shaft 18 of the motor 12 and the base plate 36 of the orbiting scroll 33. The crankshaft 51 converts rotation of the drive shaft 18 into orbital motion of the orbiting scroll 33. A splined shaft **18*a* is formed at the front end of the drive shaft 18 and projects into the suction chamber 39. A connecting sleeve 52 forms part of the drive crankshaft 51. The connecting sleeve 52 engages the splined shaft 18*a*. A web 53*a* couples an eccentric pin 53 to the connecting sleeve 52. The web 53*a* is fastened to the splined shaft 18*a* by a bolt 54. A central bearing sleeve 55, which extend axially, is integrally formed on the rear surface of the base plate 36 of the orbiting scroll 33. The eccentric pin 53 is supported by a radial ball bearing 56, which is fitted in the central sleeve 55. When the drive crankshaft 51 is rotated by the drive shaft 18, the eccentric pin 53 orbits, which causes the orbiting scroll 33 to orbit about the axis O1 of the drive shaft 18 (drive crankshaft 18). As shown in FIG. 4, the orbital radius is a distance R1 between the axis O1 and the axis O2 of the eccentric pin 53**.

As shown in FIG. 4, a central balance weight 57, which has a mass W1, is integrally formed on the web **53*a*. The central balance weight 57 is located on the opposite side of the axis O1 from the eccentric pin 53. When the orbiting scroll 33**, which has a mass WT, orbits, a centrifugal force, which is based on a moment of inertia MT ($WT*R1^2$) about the axis O1 of the drive crankshaft 51, is generated. The central balance weight 57, which has a mass W1, opposes part of the centrifugal force of the orbiting scroll 33. In other words, the central balance weight 57 balances part of the moment of inertia of the orbiting scroll 33.

Follower crankshafts 61 (three in this embodiment) are located between the support frame 16 and the base plate 36 of the orbiting scroll 33. The follower crankshafts 61 permit orbiting motion of the orbiting scroll 33 and prevent the orbiting scroll 33 from rotating about its own axis. Journal shafts 62 of the follower crankshafts 61 are supported by radial ball bearings 64, which are fitted in annular bearing supports 63. The bearing supports 63 are formed on the support frame 16. The bearing supports 63 are closed at the rear ends and extend axially. Eccentric pins 65 are integrally formed at the front ends of the follower crankshafts 61 on webs **65*a*. The eccentric pins 65 are supported by the radial ball bearings 61, which are fitted in outer bearing sleeves 66. The outer bearing sleeves 66 are formed on the rear surface of the base plate 36** and extend axially.

As shown in FIG. 4, the axes O3 of the journal shafts 62 are arranged at equal angular intervals on a circle C62 centered on the axis O1 of the drive shaft 18. The orbital radius R2 of the eccentric pins 65, which is the distance between the axes O3 of the journal shafts 62 and the axes O4 of the eccentric pins 65, is the same as the orbital radius Rl of the eccentric pin 53 of the drive crankshaft 51.

Accordingly, when the drive crankshaft 51 orbits, the follower crankshafts 61 permit orbital movement of the orbiting scroll 33 and prevent the orbiting scroll 33 from rotating about the axis O2 of the eccentric pin 53.

Figure 2:
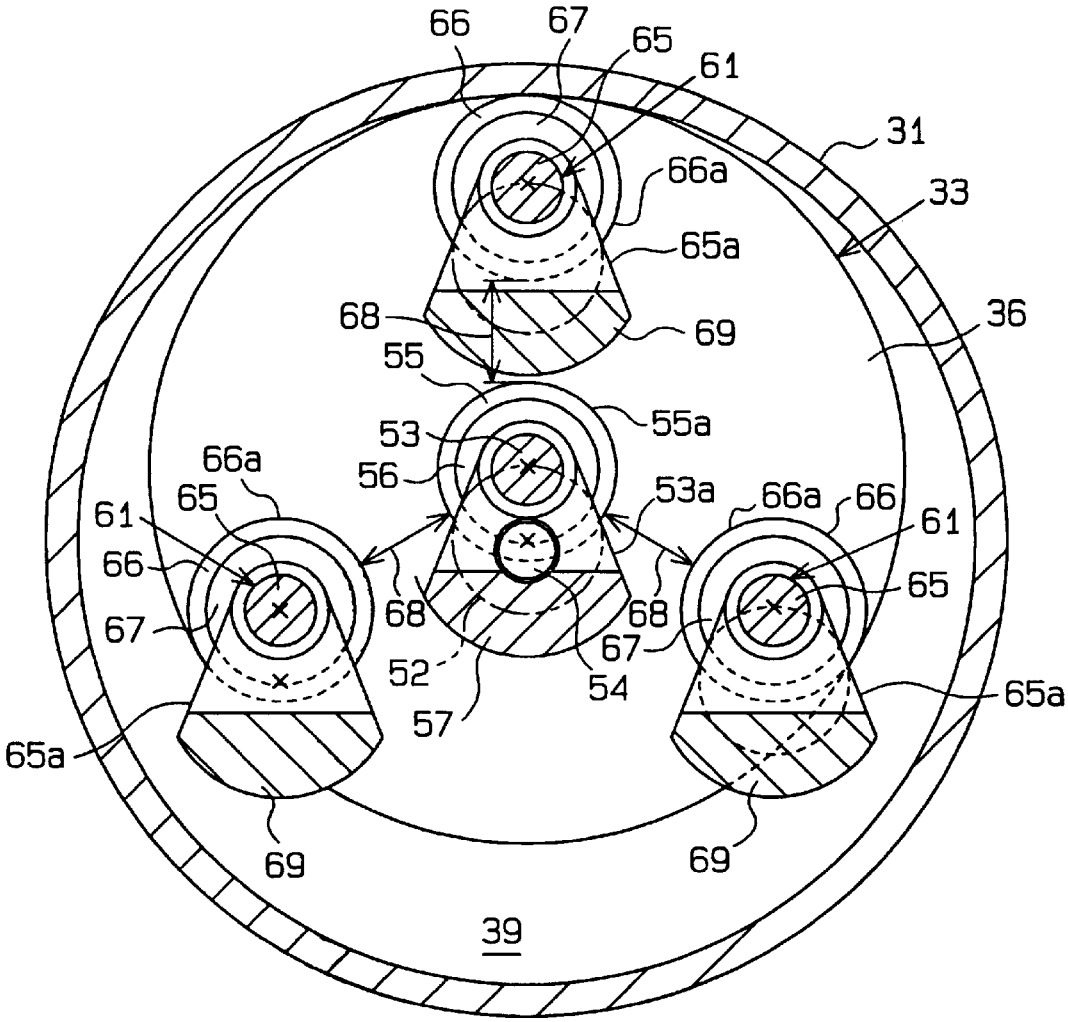
FIG. 2 is a partial transverse cross-sectional view of the scroll-type compressor.
Figure 3:
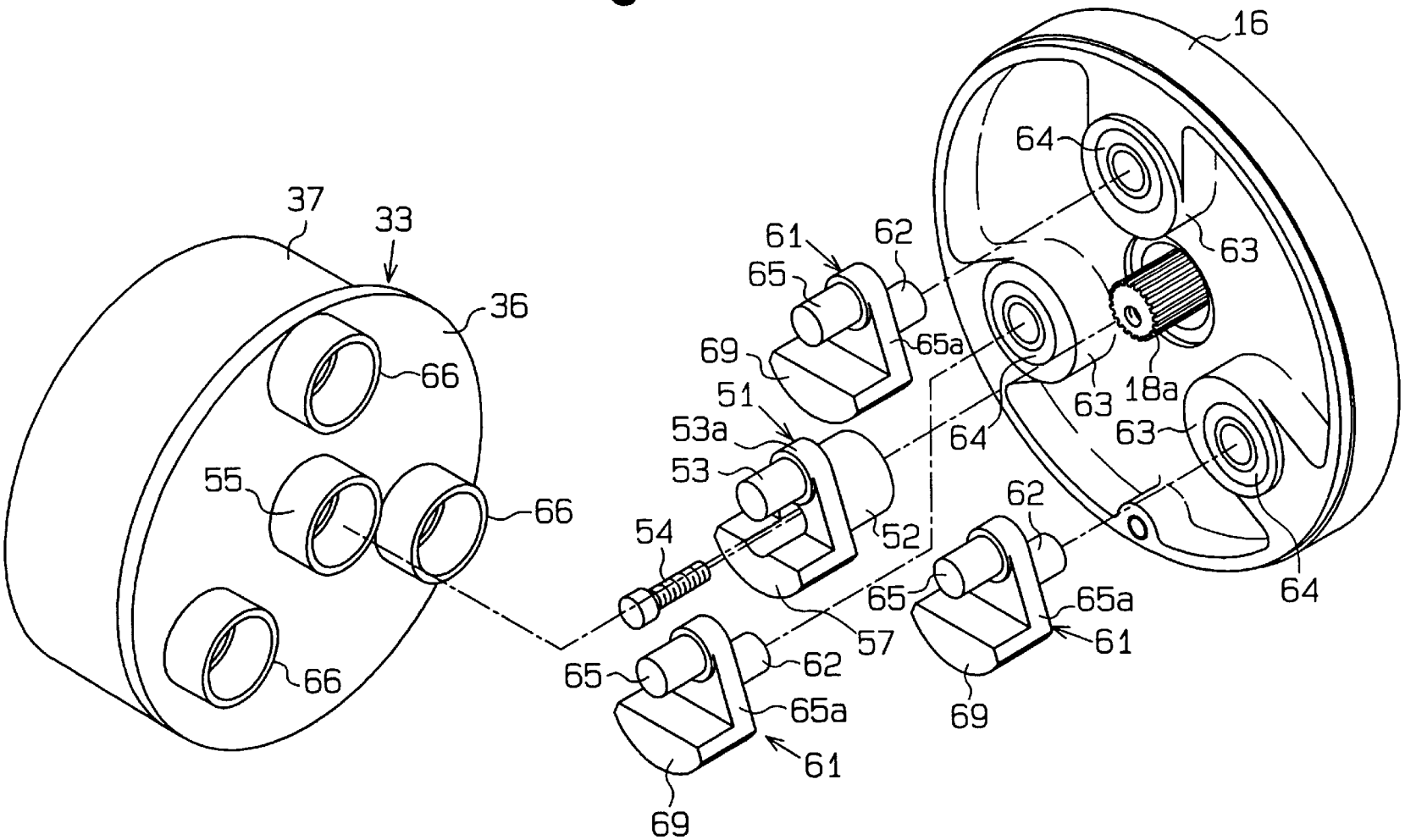
FIG. 3 is an exploded perspective view of the rotation balancing mechanism.

As shown in FIG. 2, predetermined clearances 68 are provided between the peripheral surface 55*a* of the central bearing sleeve 55 of the drive crankshaft 51 and the peripheral surfaces 66*a* of the outer bearing sleeves 66 of the follower crankshafts 61. Outer balance weights 69 are integrally formed on the webs 65*a* of the follower crankshafts 61. The outer balance weights 69 can pass through the clearances 68 when rotating. The total mass W4 of each of the outer balance weights 69 is not determined simply to balance the moment of inertia of the eccentric pins 65 about the axes O3 of the journal shafts 62 of the respective follower crankshafts 61. Since the moment of inertia MW1 ($W1*R1^2$) which is based on the mass W1 of the central balance weight 57 of the crankshaft 51, is not sufficient to balance the moment of inertia of the orbiting scroll 33, the masses W4 of the balance weights 69 are determined to compensate for the insufficiency. In other words, the outer balance weights 69 are not simply for dynamically balancing the respective follower crankshafts 61 but are also for opposing, or balancing, the moment of inertia of the orbiting scroll 33 in cooperation with tho central balance weight 57. One example of the method for determining the mass of the balance weights 57, 69 will be described as follows.

W1 represents a hypothetical mass that is located at the center of gravity G1 of the central balance weight 57 of the drive crankshaft 51. W2 represents a hypothetical mass that is located at the center of gravity G2 of each of the outer balance weights 69 to balance the moments of inertia about the axes O3 of the follower crankshafts 61, respectively. W3 represents a mass that compensates for the shortage in the mass W1 to balance the moment of inertia ($WT*Rl^2$) about the axis O1 caused by the mass WT of the orbiting scroll 33, and the centers of gravity G1, G2 are located on the circles Cr1, Cr2, which have radiuses R1, R2, respectively. Further, the journal shafts 62 of the follower crankshafts 61 are located on the circle C62 about the axis O1 of the drive shaft 18 at equal angular intervals. The center of gravity GI of the central balance weight 57 is located on the circle Crl of the axis O2 (center of gravity G3) of the eccentric pin 53 of the drive crankshaft 51 and is equidistant with the center of gravity G3 from the axis O1 of the drive shaft 18. The centers of gravity G2 of the outer balance weights 69 of the follower crankshafts 61 are located on the circles Cr2 of the axes O4 (center of gravity G4) of the eccentric pins 65 and are equidistant with the centers of gravity G4 from the axes O3 of the journal shafts 62. The centers of the circles Cr2 are the axes O3 of the journal shafts 62 of the follower crankshafts 61.

The total mass W4 of each balance weight 69 is represented by the following expression.

$$W4=W2+W3/3$$

The moment of inertia MT ($WT*R1^2$) about the axis O1 caused by the mass WT of the orbiting scroll 33 is opposed by the moment of inertia MW1 ($W1*R1^2$) about the axis O1 caused by the mass W1 of the central balance weight 57 of the drive crankshaft 51 and by the moments of inertia MW3/3($W3/3*R2^2$) about the axes O3 caused by the masses W3/3 of the outer balance weights 69 of the follower crankshafts 61.

The ratio of the mass W3, which represents the shortage of mass W1 required to counter the moment of inertia caused by the mass WT of the orbiting scroll 33 to the whole mass (W1+W3) is in the range of 20 to 100 percent.

Operation of the illustrated scroll-type compressor will now be described.

As shown in FIGS. 1, 2, and 4, when the drive shaft 18 of the motor 12 rotates, the eccentric pin 53 of the drive crankshaft 51 orbits with the radius R1 about the axis O1 of the drive shaft 18, which causes the orbiting scroll 33 to orbit about the axis O1 through the bearing 56. During this movement, the eccentric pins 65 of the follower crankshafts 61 orbit with the radius R2 (which is equal to radius R1) about the axis O3 of the journal shafts 62. This permits the orbiting scroll 33 to orbit without rotating about the eccentric pin 53.

Therefore, refrigerant gas is drawn to the suction chamber 39 through the suction port 40 and then to the compression chambers 38. As the orbiting scroll 33 orbits, the compression chambers move from the periphery to the center of the spiral portions 35, 37, and this gradually reduces their volumes. Accordingly, refrigerant gas in the compression chambers 38 is gradually compressed and is discharged to the external refrigerant circuit through the discharge port 41.

The scroll-type compressor has the following advantages.

(1) In the illustrated embodiment of FIGS. 1–4, the mass W3/3 is added to each outer balance weight 69 of the follower crankshafts 61 to generate a moment of inertia that balances part of the moment of inertia MT of the orbiting scroll 33. Therefore, it is possible to reduce the mass W1 of the central balance weight 57 of the drive crankshaft 51 and to reduce the radius of the path C1 of the central balance weight 57 as shown in FIG. 4 compared to the prior art examples. As a result, the outer bearing sleeves 66, which support the eccentric pins 65 of the follower crankshafts 61, are formed radially near the central bearing sleeve 55 of the drive crankshaft 51 on the base plate 36 of the orbiting scroll 33. Therefore, the outer bearing sleeves 66 do not extend outward from the periphery of the base plate 36, which reduces the size of the compressor housing 31.

As shown in FIG. 4, the peripheral surfaces of the outer balance weights 69 of the follower crankshafts 61 define the circles C3 about the axes O3 of the fixed journal shafts 62. Therefore, when the orbiting scroll 33 orbits, the outer balance weights 69 do not interfere with the housing 31 shown in FIG. 2.

Figure 11:
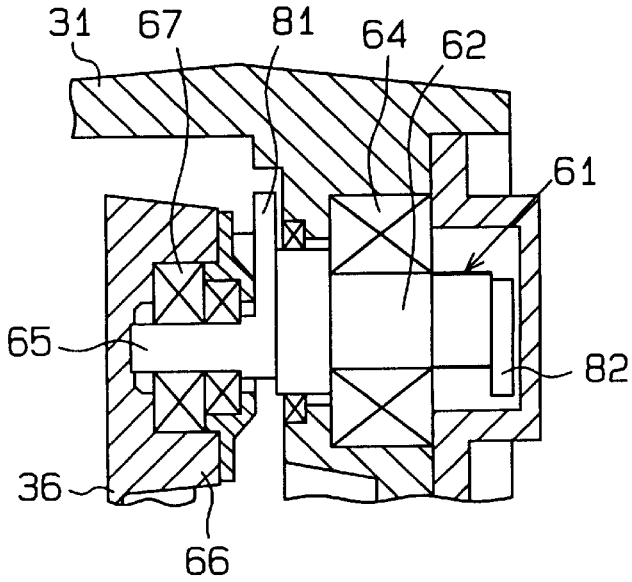
Fig.11 (Prior Art)
FIG. 11 is a partial cross-sectional view showing another prior art scroll-type compressor.

(2) In the illustrated embodiment, the clearances 68 are formed between the peripheral surface 55*a* of the central bearing sleeve 55 and the peripheral surfaces 66*a* of the outer bearing sleeves 66. The outer balance weights 69 pass through the clearances 68. Also, the center of gravity G4 is equidistant with and 180 degrees from the corresponding center of gravity G2 with respect to the axis O3 of the corresponding journal shaft 62 to generate rotational imbalance from the moment of inertia in the follower crankshaft 61. Therefore, the prior art trim weights as shown in FIG. 11 are not required, which reduces the number of parts and simplifies the structure of the compressor.

The masses W2 of the outer balance weights 69, which balance the moments of inertia about the axes O3 of the respective follower crank shafts 61, are minimized, that is, the mass W2 can be the same as the mass of one of the eccentric pins 65. This reduces the mass of the follower crankshafts 61.

(3) The moment of inertia MT ($WT*R2^2$) due to the mass WT of the orbiting scroll 33 is countered by the combination of the moment of inertia MW1 ($WT*R1^2$) caused by the mass W1 of the central balance weight 57 and the equal moments of inertia caused by the masses W3/3 of the three outer balance weights 69. This reduces the mass of each balance weight 57, 69 and also reduces the maximum radii, which relatively stabilizes the orbital movement of the orbiting scroll 33 compared to the prior art structure. In the prior art structure, a relatively great balance weight is located only on the drive crankshaft 51, and the drive crankshaft 51 orbits with a relatively large maximum path radius.

(4) In the illustrated embodiment, the journal shafts 62 of the follower crankshafts 61 are arranged on the circle C62 about the axis O1 of the drive shaft 18 at equal intervals. Also, the center of gravity G1 of the central balance weight 57 is located on the circular path Cr1 of the center of gravity G3 (axis O2) of the eccentric pin 53, which orbits about the axis O1 of the drive shaft 18 and is equidistant with the center of gravity G3 from the axis O3. Further, the centers of gravity G2 of the outer balance weights 69 of the follower crankshafts 61 are located on the circular path Cr2 of the centers of gravity G4 (axes O4) of the eccentric pins 65 about the axes O3 of the journal shafts 62, and are equidistant with the centers of gravity G4 from the axes O3, respectively.

Accordingly, this minimizes the masses W1, W4 of the central balance weight 57 and the outer balance weights 69.

(5) Under the conditions described in part (4) above, the masses W4 of the outer balance weights 69 are determined based on the expression W4=W2+W3/n. This facilitates determining the masses W4.

The present invention can further be embodied as follows.

Figure 5:
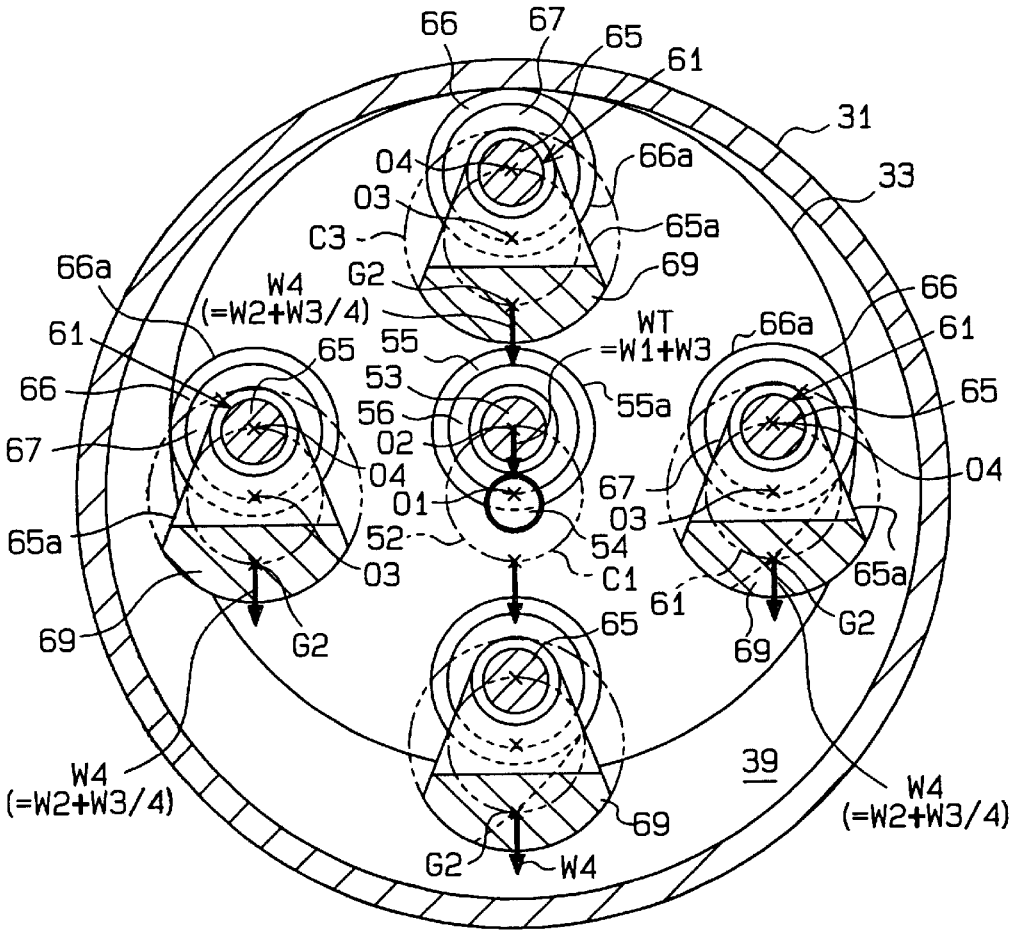
FIG. 5 is a partial cross-sectional view showing another embodiment of the present invention.

As shown in FIG. 5, the central balance weight 57 of the drive crankshaft 51 may be omitted, and outer balance weights 69 having the equal masses W4=W2+W3/4 may be attached to four follower crankshafts, which are provided at four locations. The structure of the compressor of FIG. 5 is otherwise the same as that of the first embodiment.

The embodiment of FIG. 5 has the advantages (1), (2), (3), (4), and (5).

Figure 6:
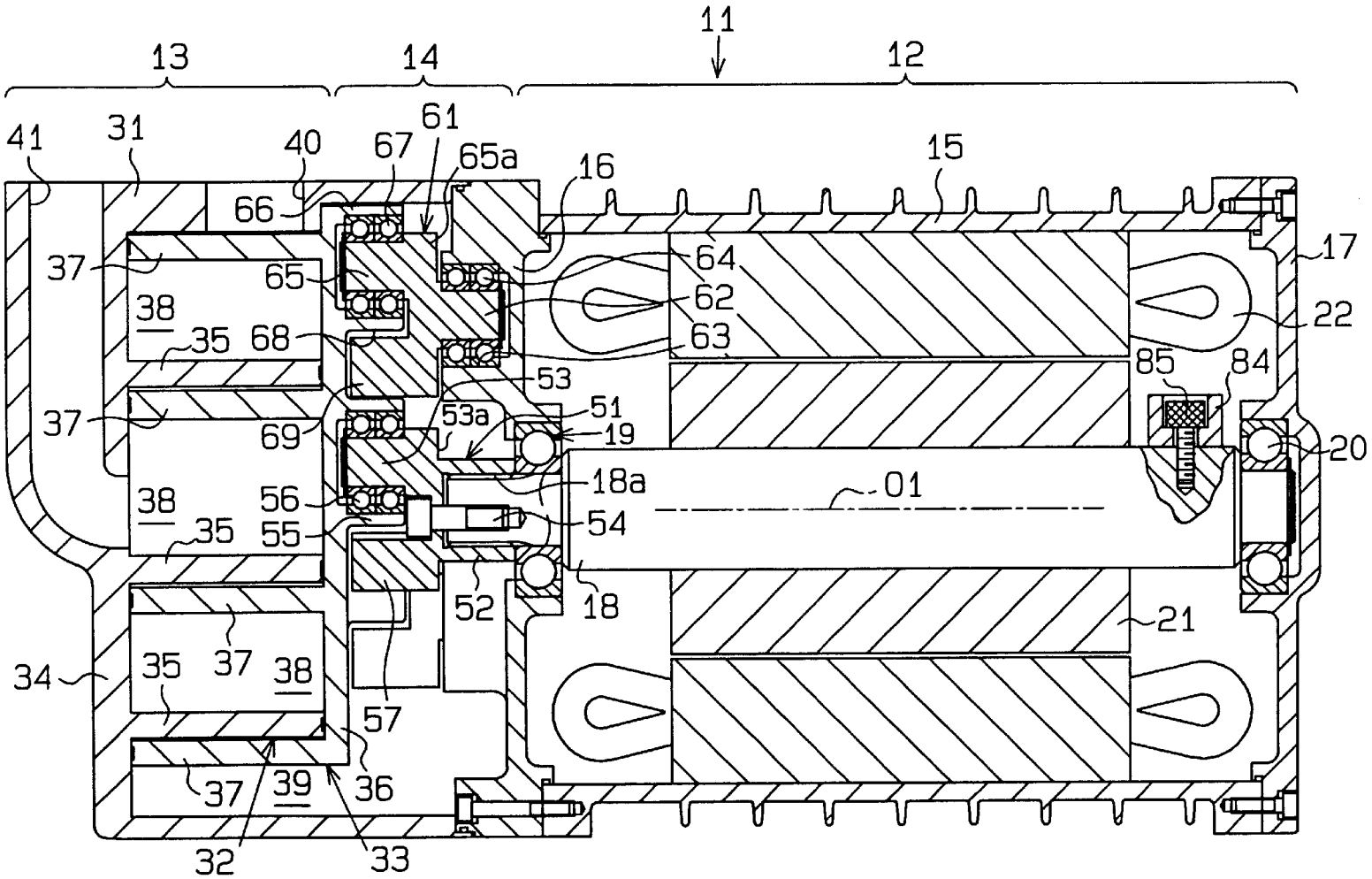
FIG. 6 is a cross-sectional view showing a scroll-type compressor according to another embodiment of the present invention.
Figure 7:
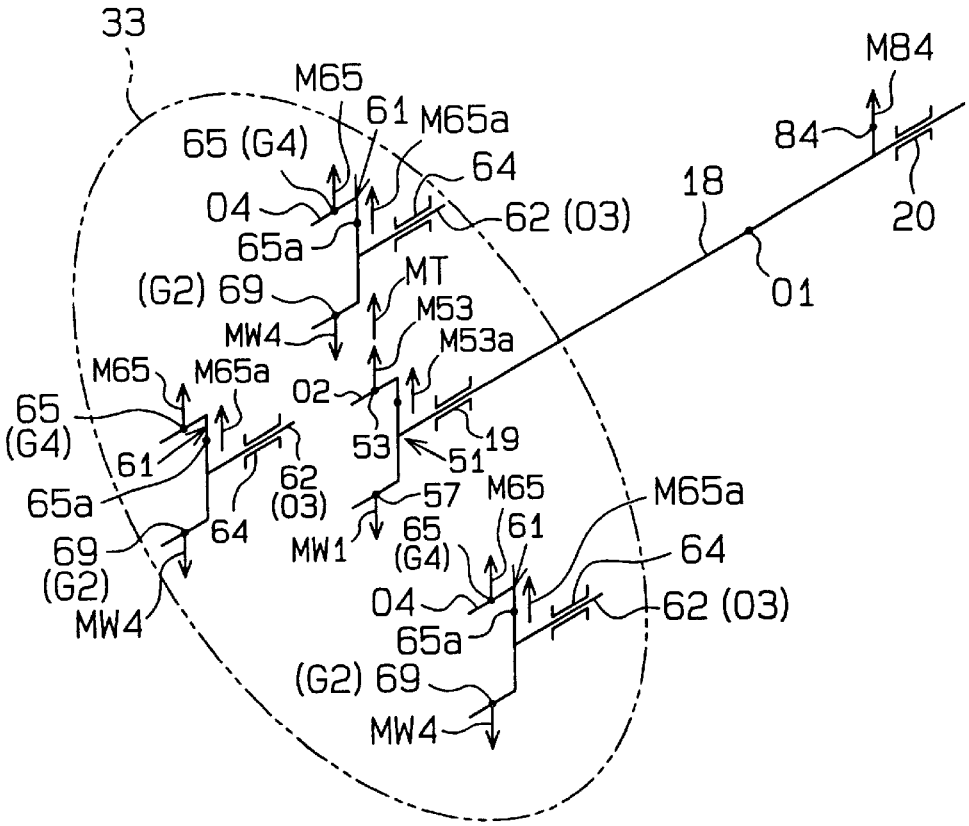
FIG. 7 is a perspective view illustrating the moment of inertia of each member of FIG. 6.

In a third embodiment shown in FIG. 6, a trim weight 84 is secured to the rear end of the drive shaft 18 (on the opposite end of the drive shaft 18 from the drive crankshaft 51) by a bolt 85. The trim weight 84 mitigates a force that tends to bend the drive crankshaft 51 (and the drive shaft 18). FIG. 7 is a diagrammatic view for illustrating the moments of inertia of each member of FIG. 6. The method of determining the mass and location of the trim weight 84 will now be described with reference to FIG. 7.

MW1 represents a moment of inertia about the axis O1 of the orbiting scroll 33, which is countered by the central balance weight 57. M65 and M65*a* represent moments of inertia about the axes O3 of the eccentric pins 65 and the webs 65*a* of the follower crankshafts 61. MW4 represents moments of inertia about the axes O3 of the outer balance weights 69. M53 and M53*a* represent moments of inertia about the axis O1 of the eccentric shaft 53 and a web 53*a* of the drive crankshaft 51. M84 represents a moment of inertia about the axis O1 of the trim weight 84. A principal axis of inertia that nullifies the product of inertia, which is the sum of these moments of inertia, is determined to coincide with the axis O1 of the drive crankshaft 51.

Accordingly, orbiting movement of the orbiting scroll 33 is smoothly performed by the drive shaft 18 and the drive crankshaft 51 in the present embodiment.

Figure 8:
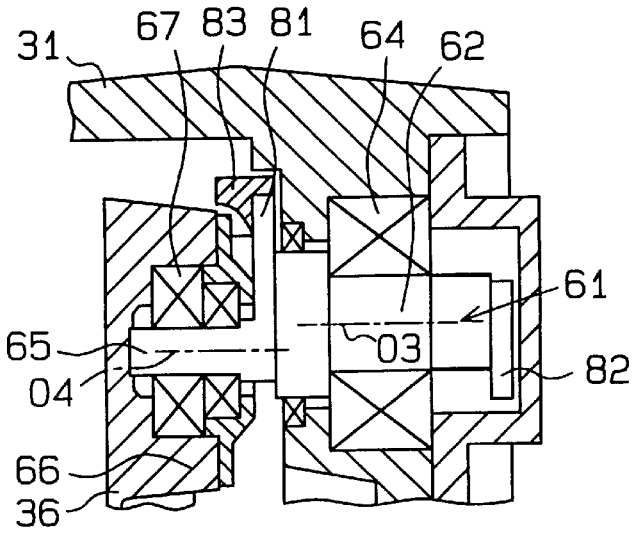
FIG. 8 is a partial cross-sectional view showing another embodiment of the present invention.
Figure 9:
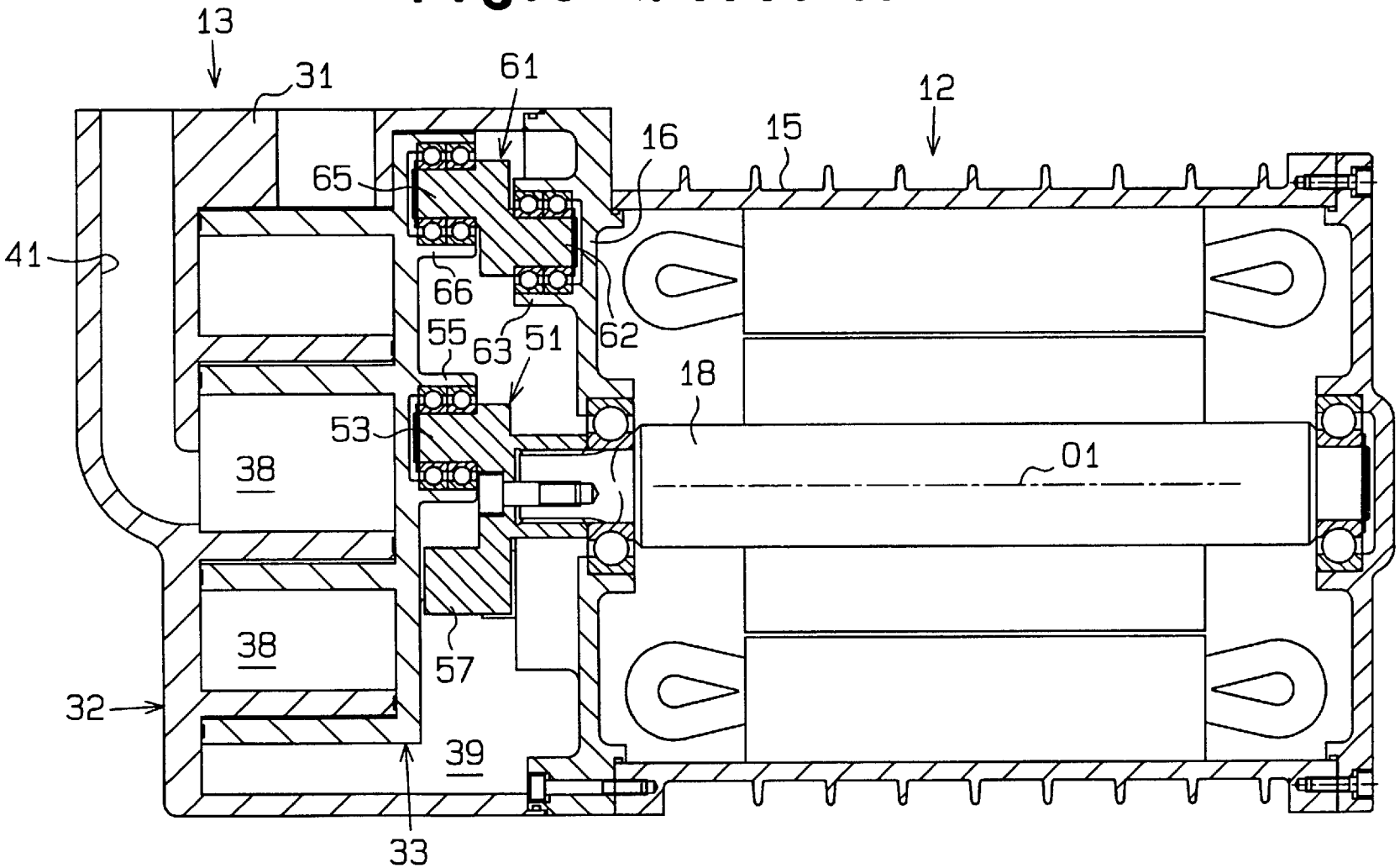
Fig.9 (Prior Art)
FIG. 9 is a cross-sectional view showing a prior art scroll-type compressor.
Figure 10:
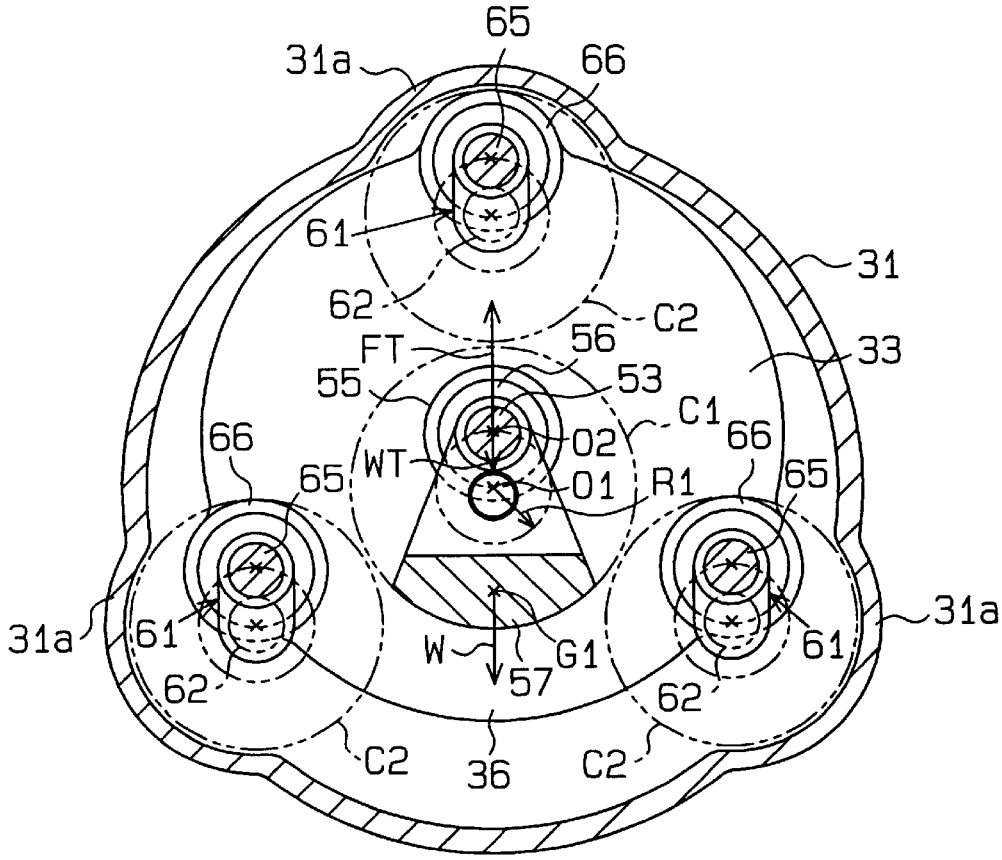
Fig.10 (Prior Art)
FIG. 10 is a transverse cross-sectional view showing the prior compressor of FIG. 9.

As shown in FIG. 8, in the prior art scroll-type compressor of FIG. 11, balance weights 83, each having a mass W3/n (n represents the number of the balance weights 83) may be attached to the balance weights 81 of the follower crankshafts 61. Accordingly, the sum of the moments of inertia about the axes O3 of the journal shafts 62 of the entire follower crankshafts 61 may not be null.

The present embodiment also prevents the outer bearing sleeves 66 from projecting from the circumferential surface of the base plate 36.

The number of the follower crankshafts 61 may be varied to be one, two, or five or more. As the number of the follower crankshafts 61 is increased, the mass W1 of the central balance weight 57 is reduced, and the mass W3/n of each outer balance weight 69 is reduced. This achieves smooth orbiting of the orbiting scroll 33. However, there is an upper limit to the number of the follower crankshafts due to interference.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A scroll type compressor comprising:

a housing;

a fixed scroll fixed to the housing, the fixed scroll having a spiral portion formed on a base thereof;

an orbiting scroll having a spiral portion formed on a base thereof to engage the fixed scroll, the orbiting scroll having a center axis offset from that of the fixed scroll;

a driving crankshaft connected to the base of the orbiting scroll to produce orbital motion;

follower crankshafts connected to the housing and the base of the orbiting scroll to follow the motion of the orbiting scroll and prevent the orbiting scroll from rotating about its own axis; and balance weights for balancing a moment of inertia of the orbiting scroll about the driving crankshaft, wherein the balance weights are located on at least the follower crankshafts.

2. A scroll type compressor as recited in claim 1, wherein the balance weights are located on both the driving crankshaft and the follower crankshafts.

3. A scroll type compressor as recited in claim 2, wherein the driving crankshaft has a connecting portion connected to a drive shaft, the driving crankshaft including an eccentric pin connected to the connecting portion by a web portion, wherein the eccentric pin is supported by a central bearing sleeve formed on the base of the orbiting scroll and wherein the balance weight of the driving crankshaft is connected to the web portion at a location that is on an opposite side of the axis of the connecting portion from the eccentric pin.

4. A scroll type compressor as recited in claim 3, wherein each of the follower crankshafts has a journal shaft, which is supported by a bearing support formed on a portion of the housing, and an eccentric pin connected to the journal shaft by the web portion, wherein each eccentric pin is supported by a respective outer bearing sleeve formed on the base of the orbiting scroll, wherein the balance weight of each of the follower crankshafts is connected to the web portion at a location that is on an opposite side of the axis of the journal shaft from the eccentric pin, wherein radial clearances exist between an outer surface of the central bearing sleeve and outer surfaces of the outer bearing sleeves, and wherein each balance weight passes through at least one of the clearances.

5. A scroll type compressor as recited in claim 4, wherein the journal shafts of the follower crankshafts are located at regular angular intervals on the same circle centered on the axis of the drive shaft, wherein the center of gravity of the balance weight of the driving crankshaft and the center of gravity of the eccentric pin are equidistant from the axis of the drive shaft, and wherein the center of gravity of the balance weight of each of the follower crankshafts and the center of gravity of the corresponding eccentric pin are equidistant from the axis of the corresponding journal shaft.

6. A scroll type compressor as recited in claim 5, wherein a mass W4 of the balance weight of each of the follower crankshafts is represented by the expression $$W4=W2+W3/n$$

wherein the moment of inertia about the axis of the driving crankshaft of the orbiting scroll is balanced by the moment of inertia about the axis of the driving crankshaft of the balance weight of the driving crankshaft and the moments of inertia about the axes of the respective follower crankshafts of the balance weights of the follower crankshafts, wherein W2 is a mass at the center of gravity of each balance weight of each of the follower crankshafts necessary to balance the centrifugal force of the associated follower crankshaft, W3 is the difference between the mass of the balance weight of the driving crankshaft and the mass required to balance the moment of inertia of the orbiting scroll, and n is the number of balance weights of the follower crankshafts.

7. A scroll type compressor as recited in claim 3, wherein the moment of inertia of the balance weight of the driving crankshaft is set to balance the moment of inertia occurring about the axis of the driving crankshaft of the eccentric pin of the driving crankshaft and a portion of the moment of inertia of the orbiting scroll, and wherein the moments of inertia of the balance weights of the follower crankshafts balance the respective moments of inertia occurring about the axes of the follower crankshafts by the eccentric pins of the follower crankshafts and a respective share of the remainder of the moment of inertia of the orbiting scroll.

8. A scroll type compressor as recited in claim 7, wherein a ratio of W3 to W1+W3 is in the range of 20% to 100%, where W1 is the mass of the balance weight of the driving crankshaft and W3 represents the difference between W1 and the mass required to balance the moment of inertia of the orbiting scroll.

9. A scroll type compressor as recited in claim 1, wherein the number of the follower crankshafts is three or more.

10. A scroll type compressor as recited in claim 1, wherein the balance weights balance the moment of inertia of the orbiting scroll, the moment of inertia of the driving crankshaft and the total moments of inertia of each of the follower crankshafts.

11. A scroll type compressor as recited in claim 10, further comprising a drive shaft for rotating the driving crankshaft and a trim weight provided on the drive shaft at a position axially spaced from the driving crankshaft, the trim weight balancing a first moment of inertia operating in a direction that tends to bend the driving crankshaft, wherein the mass and position of the trim weight are set so that a main axis of inertia coincides with the axis of the driving crankshaft where in the main axis of inertia, product of inertia becomes zero and product of inertia is the sum total of the first moment of inertia and the moment of inertia of the trim weight.

12. A scroll type compressor as recited in claim 11, wherein the product of inertia includes the sum total of the moment of inertia of the orbiting scroll, the moment of inertia of a pin and a web portion of each of the follower crankshafts, the moment of inertia of each of the balance weights of the follower crankshafts, the moment of inertia of a pin and a web portion of the driving crankshaft, the moment of inertia of the balance weight of the driving crankshaft and the moment of inertia of the trim weight.

13. A scroll type compressor as recited in claim 11, further comprising a trim weight provided on each follower crankshaft at a position axially spaced from the orbiting scroll, the trim weight balancing a moment of inertia created by the balance weight of the corresponding follower crankshafts in a direction that tends to bend the corresponding follower crankshaft.

14. A scroll type compressor as recited in claim 1, wherein a central bearing sleeve is provided on the base of the orbiting scroll to receive part of the driving crankshaft to cause the orbiting scroll to orbit, and outer bearing sleeves are provided on the base of the orbiting scroll to receive parts of the follower crankshafts, wherein there are radial clearances between each outer bearing sleeve and the central bearing sleeve, and wherein each of the balance weights passes through at least one of the clearances.

* * * * *

UNITED STATES PATENT AND TRADEMARK OFFICE

CERTIFICATE OF CORRECTION

PATENT NO. : 6,190,147 B1
DATED : February 20, 2001
INVENTOR(S) : Masahiko Kimbara et al It is certified that error appears in the above-identified patent and that said Letters Patent is hereby corrected as shown below:

Column 1,
Line 22, please change: "crankshafts 61 arc located" to -- crankshafts 61 are located --;

Column 5,
Line 24, please change: "$(W1*R1^2)$ which is" to -- $(W1*R1^2)$, which is --.

Signed and Sealed this

Fourteenth Day of May, 2002

*Attest:*

*Attesting Officer*

JAMES E. ROGAN
*Director of the United States Patent and Trademark Office*